United States Patent [19]

Zettier

[11] 4,210,275

[45] Jul. 1, 1980

[54] CONTINUOUSLY OPERATING CENTRIFUGAL SEPARATOR

[75] Inventor: Karl-Heinz Zettier, Oelde, Fed. Rep. of Germany

[73] Assignee: Westfalia Separator Aktiengesellschaft, Oelde Westfalen, Fed. Rep. of Germany

[21] Appl. No.: 933,367

[22] Filed: Aug. 14, 1978

[30] Foreign Application Priority Data

Aug. 19, 1977 [DE] Fed. Rep. of Germany ..... 2737463

[51] Int. Cl.[2] ..... B04B 11/00

[52] U.S. Cl. ..... 233/20 R

[58] Field of Search ..... 233/20 R, 20 A, 1 R, 233/1 A

[56] References Cited

U.S. PATENT DOCUMENTS

| | | | |
|---|---|---|---|
| 2,139,715 | 12/1938 | Bergner | 233/1 A |
| 3,930,609 | 1/1976 | Nelson | 233/20 A |

FOREIGN PATENT DOCUMENTS

| | | | |
|---|---|---|---|
| 894826 | 10/1953 | Fed. Rep. of Germany | 233/20 R |
| 1516026 | 1/1968 | France | 233/20 R |

*Primary Examiner*—George H. Krizmanich

*Attorney, Agent, or Firm*—Sprung, Felfe, Horn, Lynch & Kramer

[57] ABSTRACT

A centrifugal separator having an upper paring chamber 5 and paring disc 6, a lower paring chamber 8 and paring disc 9, an air seal 10, 11 over the upper paring chamber and paring disc, and a radially extending overflow passage 15 disposed between the upper and lower paring chamber for discharge of liquid overflowing from either paring chamber, is provided with a shutoff valve 17 in the overflow passage 15 which is urged to the closed position by centrigual force and has a shoulder 20 for exposure to liquid in the overflow passage when the valve is in the closed position so that centrifugal force of liquid in the overflow passage urges the valve toward the open position. The shut-off valve prevents air from entering through the overflow passage.

6 Claims, 2 Drawing Figures

CONTINUOUSLY OPERATING CENTRIFUGAL SEPARATOR

BACKGROUND

Figures 1, 2:
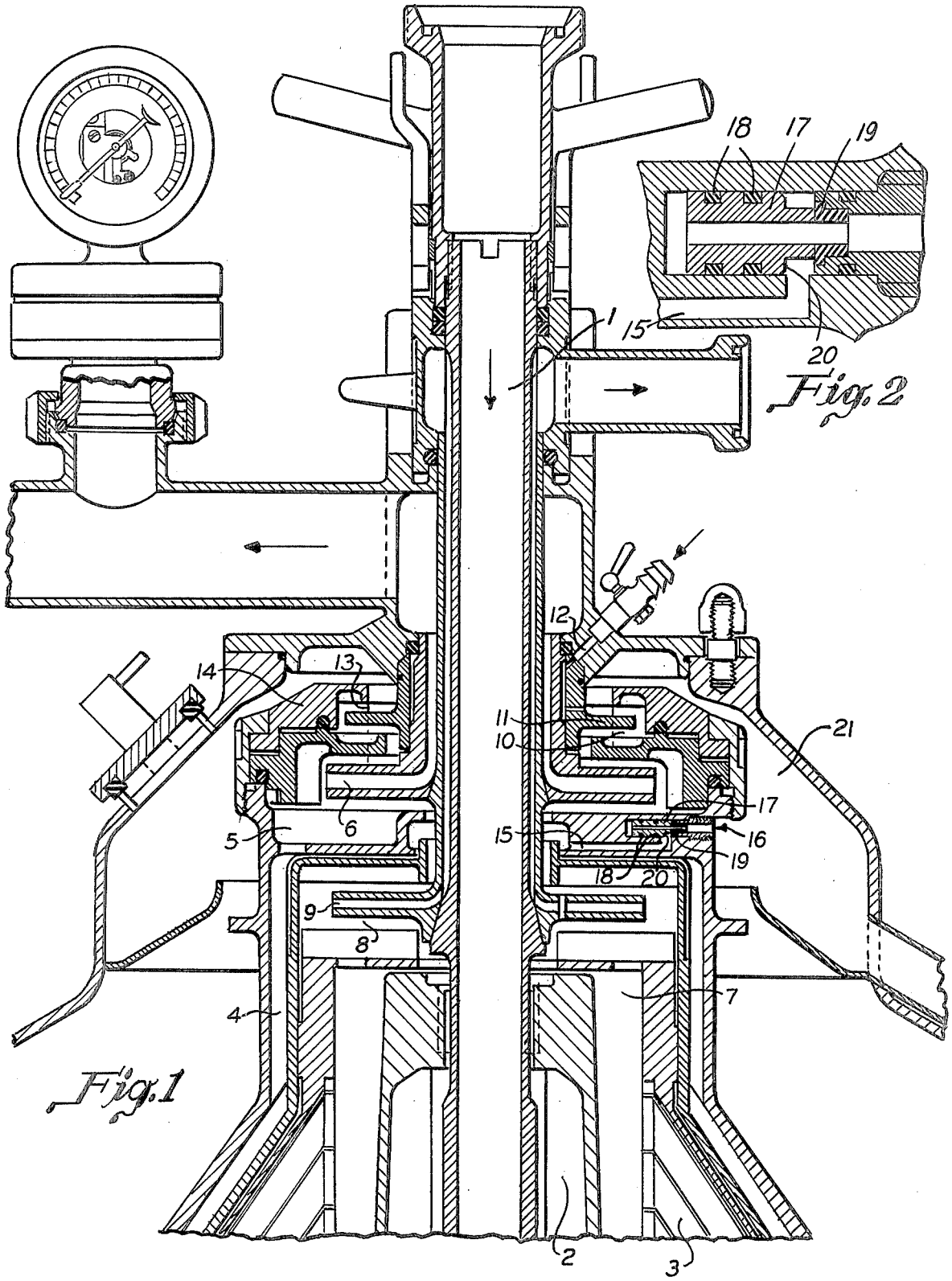

The invention relates to a continuously operating centrifugal separator for separating liquid mixtures, which has paring means for the continuous discharge of the separated liquid phases, an air seal plate being provided above the upper paring means, the air seal plate being fixedly joined to the paring means and extending into a liquid barrier revolving with the centrifuge drum, and one or more radially disposed overflow passages being provided in the centrifuge drum between the lower and upper paring means.

Such centrifugal separators are known, in which the air seal plate extending into a liquid barrier and disposed above the upper paring means prevents the entry of atmospheric air into the upper paring chamber and hence the entry thereof into the liquid discharged from this chamber by the paring means.

The liquid barrier required for the sealing of the air seal plate can consist of a foreign liquid or a portion of the liquid being removed by the upper paring means.

The overflow passages radially disposed between the two paring means serve for the purpose of removing from the drum liquids overflowing from the upper and/or lower paring chambers, so as to prevent any mingling of the two phases in either of the paring chambers due to overflow.

In the case of liquids which are sensitive to air and which must be kept germ-free, these overflow passages disposed between the paring chambers and connected to the outer drum chamber have proven to be a drawback, since atmospheric air can be drawn through these open passages into the centrifuge drum and can thus enter into the liquid, and in many products this can result in infections which it is essential to avoid.

THE INVENTION

The object of the present invention therefore consists in designing a centrifuge of the type referred to in the beginning such that no atmospheric air will be able to enter the centrifuge drum during operation and thus enter the liquid being separated, and that the mingling of overflowing liquid in either of the paring chambers will be prevented.

This object is achieved by providing shut-off means in the overflow passages.

In one special embodiment, these shut-off means consist of valves which seal off the overflow passages during operation by the action of the centrifugal forces in the rotating centrifuge drum.

Furthermore, these valves are provided with a shoulder such that, under the effect of the fluid pressure of overflowing liquid in the overflow passages, the valves will be displaced radially to the axis and the overflow passages are automatically released for the emptying of the liquid. This assures that, during operation, the overflow passages and hence the liquid in the centrifuge drum, will be shut off entirely from the atmosphere and no atmospheric air can enter, the liquid overflowing from the paring chambers will escape automatically from the paring chambers through the overflow channels, and there will be no danger of any mingling of liquid in either of the paring chambers.

An embodiment of the invention is represented in the drawings, of which:

FIG. 1 is a cross-sectional view of the upper part of a centrifuge according to the inventors; and FIG. 2 is an enlarged view of the valve 17 and adjacent structure of the centrifuge of FIG. 1.

The liquid mixture that is to be separated flows through the entry tube 1 into the entry chamber 2 of the centrifuge drum and from there into the separating chamber 3 where the separation of the liquid mixture into a specifically heavy and a specifically lighter liquid phase takes place. The separated heavier phase flows through passage 4 into the upper paring chamber 5 in which the upper paring means 6 is disposed for the discharge of the heavier phase. The separated lighter phase flows through the passage 7 and arrives in the lower paring chamber 8, where the paring means 9 is disposed for the removal of the lighter liquid phase.

Above the upper paring chamber 5 there is provided an additional chamber 10 in which an air seal plate 11 is disposed, which is fixedly joined to the upper paring means 6 and is immersed to a depth beyond the overflow line 13 of the chamber cover 14 in a barrier of liquid which is continuously injected through an input line 12. The air seal plate immersed in the rotating liquid barrier results in a hydrohermetic seal from the upper paring chamber 5. The excess of barrier liquid injected flows over the edge 13 into the outer drum chamber 21.

Between the upper and lower paring means 6 and 9, the centrifuge drum is provided with one or more radially extending overflow passages 15 in which shut-off means 16 are disposed in accordance with the invention. These shut-off means consist substantially of the valves 17 which are movable radially, and, by means of sealing rings 18 and 19, seal off the overflow passages 15.

The shut-off means operate as follows:

During operation, the valves 17 under the effect of centrifugal force seal off the overflow passages 15, so that no atmospheric air can enter through these passages into the paring chambers and thus into the liquids being carried out of them. Any liquid overflowing from the paring chambers collects in the overflow passages 15, and this liquid, under the action of the fluid pressure produced by the centrifugal force, exerts an opening action on the shoulder 20 of the valve 17 and displaces the valve radially towards the drum axis, so that the liquid present in the overflow passages is ejected from the drum and thus no commingling of the two phases can take place in either of the two paring chambers.

After the passages have been emptied, the valves automatically reclose the overflow passages. Thus the paring chambers in separating centrifuges having paring discs are completely sealed off from external atmospheric air influences during operation.

The invention is not restricted to application in the separating centrifuges equipped with a plurality of paring means as described by way of example, but it can also be used advantageously in centrifuges having a single paring means and having overflow passages which are disposed beneath or above the paring chambers.

SUMMARY

Thus, the invention is directed to a continuously operating separating centrifuge for separation of liquid mixtures, comprising a separating chamber for effecting the separation, paring means including a paring chamber, for continuous discharge of a separated liquid phase from the separating chamber, an air seal means disposed over the paring means for preventing air from entering the paring chamber from above and a radially extending overflow passage in communication with the paring chamber and with the outside of the centrifuge. The invention provides the improvement which comprises shut-off means disposed in the overflow passage for preventing air from entering the overflow passage from the outside of the centrifuge. The shut-off means comprises a valve disposed in the centrifuge for being urged to move radially under the action of centrifical force to the closed position, and a shoulder for exposure to liquid in the overflow passage when the valve is in the closed position so that centrifical force of liquid in the overflow passage urges the valve toward the open position.

What is claimed is:

1. In the continuously operating separating centrifuge for separation of liquid mixtures, comprising a separating chamber for effecting the separation, paring means including a paring chamber, for continuous discharge of a separated liquid phase from the separating chamber, air seal means disposed over the paring means for preventing air from entering the paring chamber from above, and a radially extending overflow passage in communication with the paring chamber and with the outside of the centrifuge for receiving and discharging of overflow of the paring chamber, the improvement which comprises shut-off means disposed in the overflow passage for preventing air from entering the overflow passage from the outside of the centrifuge.

2. Centrifuge of claim 1, wherein the air seal means comprises a chamber for receiving a sealing liquid and a plate for immersion in the sealing liquid.

3. Centrifuge of claim 1, wherein the shut-off means comprises a valve disposed in the centrifuge for being urged to move radially under the action of centrifugal force to the closed position and sealing rings for preventing leakage with the valve in the closed position.

4. Centrifuge of claim 3, the valve comprising a shoulder for exposure to liquid in the overflow passage when the valve is in the closed position so that centrifugal force of liquid in the overflow passage urges the valve toward the open position.

5. In a continuously operating separating centrifuge for the separation of liquid mixtures, comprising a separating chamber for effecting the separation, an upper and a lower paring means each including a paring chamber, for continuous discharge of separated liquid phases from the separating chamber, air seal means disposed over the upper paring means for preventing air from entering the upper paring means from above, and a radially extending overflow passage in communication with the upper and lower paring chambers and with the outside of the centrifuge for discharge of liquid overflowing from either of the paring chambers, the improvement which comprises shut-off means disposed in the overflow passage for preventing air from entering the overflow passage from outside the centrifuge.

6. Centrifuge of claim 5, wherein the shut-off means comprises a valve disposed in the centrifuge for being urged to move radially under the action of centrifugal force to the closed position, and the valve comprises a shoulder for exposure to liquid in the overflow passage when the valve is in the closed position so that centrifugal force of liquid in the overflow passage urges the valve toward the open position.

* * * * *